US006105895A

United States Patent [19]

Schmodde et al.

[11] Patent Number: 6,105,895

[45] Date of Patent: Aug. 22, 2000

[54] YARN TENSION SENSOR WITH IMPROVED CALIBRATION

[75] Inventors: Hermann Schmodde, Horb-Dettlingen; Eberhard Leins, Horb; Friedrich Weber, Herzogsweiler, all of Germany

[73] Assignee: Memminger-IRO GmbH, Dornstetten, Germany

[21] Appl. No.: 09/268,854

[22] Filed: Mar. 15, 1999

[30] Foreign Application Priority Data

Mar. 14, 1998 [DE] Germany ..... 198 11 241

[51] Int. Cl.[7] ..... B65H 23/06; B65H 59/02; B65H 77/00; B65H 23/18; B65H 59/18

[52] U.S. Cl. ..... 242/420.6; 242/418.1; 226/45

[58] Field of Search ..... 242/418.1, 420.6, 242/421.7; 73/862.39, 1.08; 226/45

[56] References Cited

U.S. PATENT DOCUMENTS

| | | | |
|---|---|---|---|
| 3,578,795 | 5/1971 | Polese . | |
| 3,807,612 | 4/1974 | Eggert | 242/418.1 X |
| 3,858,416 | 1/1975 | White et al. . | |
| 4,347,993 | 9/1982 | Leonard . | |

FOREIGN PATENT DOCUMENTS

| | | |
|---|---|---|
| 0 305 811 A2 | 3/1989 | European Pat. Off. . |
| 0 406 735 A2 | 1/1991 | European Pat. Off. . |
| 39 42 341 | 6/1991 | Germany . |
| 193 37 215 | 4/1997 | Germany . |
| 195 37 215 A1 | 4/1997 | Germany . |
| 359128168 | 7/1984 | Japan . |
| 8301497 | 11/1984 | Netherlands . |
| 2 015 589 A | 9/1979 | United Kingdom . |
| WO 97/13131 | 4/1997 | WIPO . |

*Primary Examiner*—Donald P. Walsh
*Assistant Examiner*—Collin A. Webb
*Attorney, Agent, or Firm*—Frishauf, Holtz, Goodman, Langer & Chick, P.C.

[57] ABSTRACT

A yarn feeder intended particularly for flatbed knitting machines and elastic yarns has a yarn tension sensor which is provided with a calibration device. This device lifts the yarn from a peg that is part of the yarn tension sensor, at times in which this can be done without impairing operation of the yarn feeder. Such times are preferably time slots when no yarn feeding is necessary. Once the yarn has been lifted from the peg, a zero point calibration is performed. Zero point drifting of the entire sensor system, including its measurement circuit, can be detected and compensated for.

26 Claims, 8 Drawing Sheets

YARN TENSION SENSOR WITH IMPROVED CALIBRATION

FIELD OF THE INVENTION

The invention relates to a yarn tension sensor, in particular for feeding elastic yarns to knitting machines, to a yarn feeder for knitting machines, and to a method for calibrating a yarn tension sensor.

BACKGROUND OF THE INVENTION

In many industrial textile applications, especially in knitting machines, it is often necessary to keep yarns which are to be furnished to knitting stations or other locations at a constant tension. This is especially important in flatbed knitting machines, which because of the reciprocating motion of the yarn guide (carriage) have a yarn consumption that fluctuates very greatly over time. A corresponding yarn feeder must then furnish the yarn at a speed that repeatedly varies abruptly over time. If the yarn tension changes, for instance during, before or after the reversal of motion of the yarn guide, then the mesh size of the knitted product changes, which impairs its appearance, elasticity, and quality. In this respect, the edge regions of knitted goods made on flatbed knitting machines are especially critical.

Special demands must be made of the constancy of tension when elastic yarns (e.g. Spandex™) are supplied, which are for instance knitted jointly with other yarns. To keep the yarn tension constant, it is necessary to monitor the tension constantly and to regulate the yarn feed quantity accordingly.

To that end, a yarn feeder for elastic yarns is known, for instance from German Patent Disclosure DE 195 37 215 A1, that is intended for use in flatbed knitting machines. The yarn feeder is used to feed Spandex™ yarns and has a yarn feed wheel driven by an electric motor. The electric motor is triggered by a closed control loop that detects the current yarn tension with a yarn tension sensor. The yarn tension sensor has a peg that can be deflected crosswise to the yarn travel direction, and the yarn is guided over this peg at an obtuse angle. The peg deflection corresponds to the yarn tension and is detected by a suitable travel sensor.

A yarn feeder for knitting machines is also known from U.S. Pat. No. 3,858,416; it likewise has a yarn feed wheel which is driven by a motor. The motor is triggered by a closed control loop that detects the yarn tension with a yarn tension sensor. The yarn tension sensor has a deflectable peg over which the yarn travels.

From German Patent Disclosure DE 39 42 341 A1, a force sensor for monitoring yarn tensions is known in which a sensor element is supported on a spring parallelogram. The deflection of the sensor element is transmitted to a bending body that is provided with variable resistance, so that the deflection of the sensor element and thus the yarn tension can be detected electrically.

The constancy of tension is of major importance especially when elastic yarns for making elastic knitted goods are being supplied. Even minimal fluctuations, and especially longer-lasting changes, lead to changes or variations in quality. It is therefore important that the yarn tension be kept stable over long periods of time, that is, over the course of hours, days and months.

Knitting machines and yarn feeders are often used in large factory spaces in which the temperature varies, both over the course of the day and depending on how long the machines have been running, and not least because of the heat loss from the knitting machines. Thus the temperatures of the yarn tension sensors vary as well, which despite temperature compensation means that may be present can have an effect on their output signal. Persistent dirt deposits can also lead to a change in the sensor output signal, for instance if deposits on a peg for detecting the yarn tension increase the total weight of the peg and thus shift the zero point of the signal.

SUMMARY OF THE INVENTION

It is an object of the invention to create a yarn tension sensor which enables stable detection of the yarn tension over long periods of time.

Another object of the invention is to provide a yarn feeder that supplies the yarn at a constant yarn tension, for instance in a flatbed knitting machine.

It is a further object of the invention to provide a method for operating a yarn tension sensor in the employment of which the sensor outputs a reliable output signal that is stable over long periods of time.

These and other objects are attained in accordance with one aspect of the invention which is directed to a yarn tension sensor that, in addition to its yarn feeler element, which is used to measure the yarn tension by being in contact with the yarn, the yarn tension sensor has a yarn takeup system that is movably supported. It has at least two different positions, which differ in that in a calibration position, the yarn is separated from the yarn feeler element and in the measurement position of the yarn takeup system, the yarn rests on the yarn feeler element. Thus, by adjusting the yarn takeup system and/or the yarn tension sensor, it is possible to lift the yarn arbitrarily from the yarn feeler element so that the yarn feeler element assumes its position of rest. This position is defined in that no force is acting on the yarn feeler element. The measuring device detects this position or this state of the yarn feeler element. If drift has occurred in the mechanical or electrical system of the yarn tension sensor, this can be recognized and detected when the yarn lifts from the yarn feeler element. For instance, the lifting of the yarn from the yarn feeler element can be used for the zero calibration of the yarn tension sensor. In this way, even long-term offsets can be averted which would otherwise be superimposed on the output signal of the yarn tension sensor. With the recognition and exclusion of offset factors that could for instance be caused by temperature drifting or by deposits on the yarn feeler element, a sensor output signal is generated over the long term that reproduces the yarn tension in a manner free of zero point errors. This makes it possible to construct a yarn feeder with high long-term constancy of the yarn tension.

This is achieved by repeatedly calibrating the yarn tension sensor over the course of yarn feeder operation, and particularly by repeatedly performing a zero point calibration. This is attained by lifting and/or moving the yarn away from the yarn tension sensor and detecting the measured value with the yarn lifted away. The measured value detected is the zero point for the yarn tension detected by the yarn tension sensor after the yarn has been placed back on the yarn feeler element.

In a first embodiment, the yarn feeler element and the yarn takeup system are disposed on opposite sides of the yarn travel. For measuring, the yarn takeup system "presses" the yarn against the yarn feeler element. For calibration, it causes the yarn to lift away from the yarn feeler element.

In a second embodiment, the yarn feeler element and the yarn takeup system are disposed on the same side of the yarn travel. For calibration, the yarn takeup system "presses" the yarn away from the yarn feeler element. For measurement, it causes the yarn to rest on the yarn feeler element.

In both embodiments, the sensor can be moved in a first design, while in a second design the yarn feeler element is movably supported.

The calibration or zero point calibration operation is preferably performed whenever the yarn feeder is not furnishing any yarn. Fluctuations in yarn tension caused or allowed by the zero point calibration during this period of time cannot cause any impairment of the knitted goods produced. Alternatively, it is possible to perform the zero point calibration by briefly lifting the yarn from the yarn feeler element when the yarn is moving slowly or is not changing its speed of motion at the moment. In that case, the regulating device that regulates the yarn feed is briefly blocked; that is, its output signal is frozen at the current value, the zero point calibration is performed, and the closed control loop is re-activated once the yarn has been placed back on the yarn feeler element.

For reliably detecting that the motor is stopped for a long enough time, the motor trigger signal is monitored. If a pronounced transition of the trigger signal from a value other than zero to the value of zero appears, then it is assumed that the motor has been stopped intentionally. In flatbed knitting machines, because of the special mode of operation after an intentional stop of the feed wheel mechanism motor, restarting of the engine can be expected at the earliest after a predetermined period of time has elapsed; in this example approximately 500 ms. The same is true upon a yarn change in stocking or sock knitting machines. Preferably, a waiting period of 20 ms, for instance, is waited out, and if the trigger signal after this waiting period has elapsed is still zero, then the calibration operation is permitted. This operation lasts several tens of milliseconds. The calibration operation is performed only when permitted (enabled) and (as a second criterion) when required. As a rule, this is done at regular time intervals. These intervals can be shorter (e.g., every two minutes) at first, after the machine is turned on, and then longer (e.g., every 30 minutes) once the machine is up to its operating speed.

The yarn tension sensor preferably has a drive mechanism, such as a tension magnet or other kind of drive mechanism (electrical or pneumatic drive mechanism of the rotary, pivoting or linear type) assigned to the yarn takeup system. This mechanism can be activated by a calibration device and drives the cam in such a way that the yarn takeup system is moved to its first position in which the yarn is lifted from the yarn feeler element.

The zero point calibration can now be performed. Once the drive mechanism is deactivated, the yarn takeup system assumes its second position, in which the yarn rests on the yarn feeler element. Preferably, in this position the yarn takeup system is separated from the yarn, or in other words does not touch it. This eliminates measurement errors from friction of the yarn against the yarn takeup system. However, it is also possible to utilize the yarn takeup system intentionally for guiding the yarn. In the first version described above, the yarn is in engagement with either the yarn takeup system or the yarn feeler element. In the second variant, the yarn is always in contact with the yarn takeup system, regardless of whether it is lifted away from the yarn feeler element or not.

The yarn takeup system is formed by one and preferably two yarn receivers adjacent to the yarn feeler element. In the simplest case, these are pegs that extend parallel to the preferably also peglike yarn feeler element. Eyelets can also be used. Both the peg of the yarn feeler element and the pegs of the yarn takeup system extend crosswise to the yarn travel direction, preferably at a right angle to it. As a result, it is attained that even with relatively wide pegs, all the yarn positions on the peg are of equal rank, so that the yarn does not dig in at any one point.

The yarn feeler element of the yarn tension sensor is preferably supported on a spring parallelogram. The preferably peglike yarn feeler element is then disposed at a right angle to the leaf springs. As a result, it suffices to fasten and support the yarn feeler element on only one side, and good dimensional accuracy is assured.

The measuring device preferably has two travel pickups, whose output signals preferably vary inversely upon a deflection of the yarn feeler element. This makes offset suppression in the evaluation circuit possible. This circuit is preferably a subtractor circuit, which can be formed by a bridge circuit, operational amplifier, or other suitable means.

The yarn tension sensor of the invention and the yarn feeder of the invention are intended for use in a flatbed knitting machine, for instance, in which the aforementioned calibration operation or zero point calibration operation can be done for instance upon a reversal of direction of the yarn guide or upon a yarn change. If the yarn guide is moving away from the yarn feeder, for instance, and stops at the end of its movement stroke in order to turn around, then the required yarn feed quantity, regardless of the knitting pattern at the time, is briefly zero. A separate calibration circuit can detect this and can activate the drive mechanism briefly so that the yarn is lifted from the yarn feeler element and the measured value that is then established is detectable as a zero point. Once this has been done, the calibration circuit deactivates the drive mechanism, so that the yarn is placed back on the yarn feeler element. The entire operation can be completed within from several milliseconds to several tens of milliseconds, given a suitable design of the yarn tension sensor and of the drive mechanism for the yarn takeup system. The stoppage time available at the change of direction of the yarn guide is thus sufficient to perform the calibration.

It is also possible to perform the calibration at other occasions that involve low yarn travel speed or a zero yarn travel speed. For instance, the yarn feeder can be operated in a standby or stopped mode upon stoppage of the knitting machine. If the yarn feeder is moved out of this state (turned on), then the brief calibration operation can be performed.

DETAILED DESCRIPTION OF THE INVENTION

Figure 1:
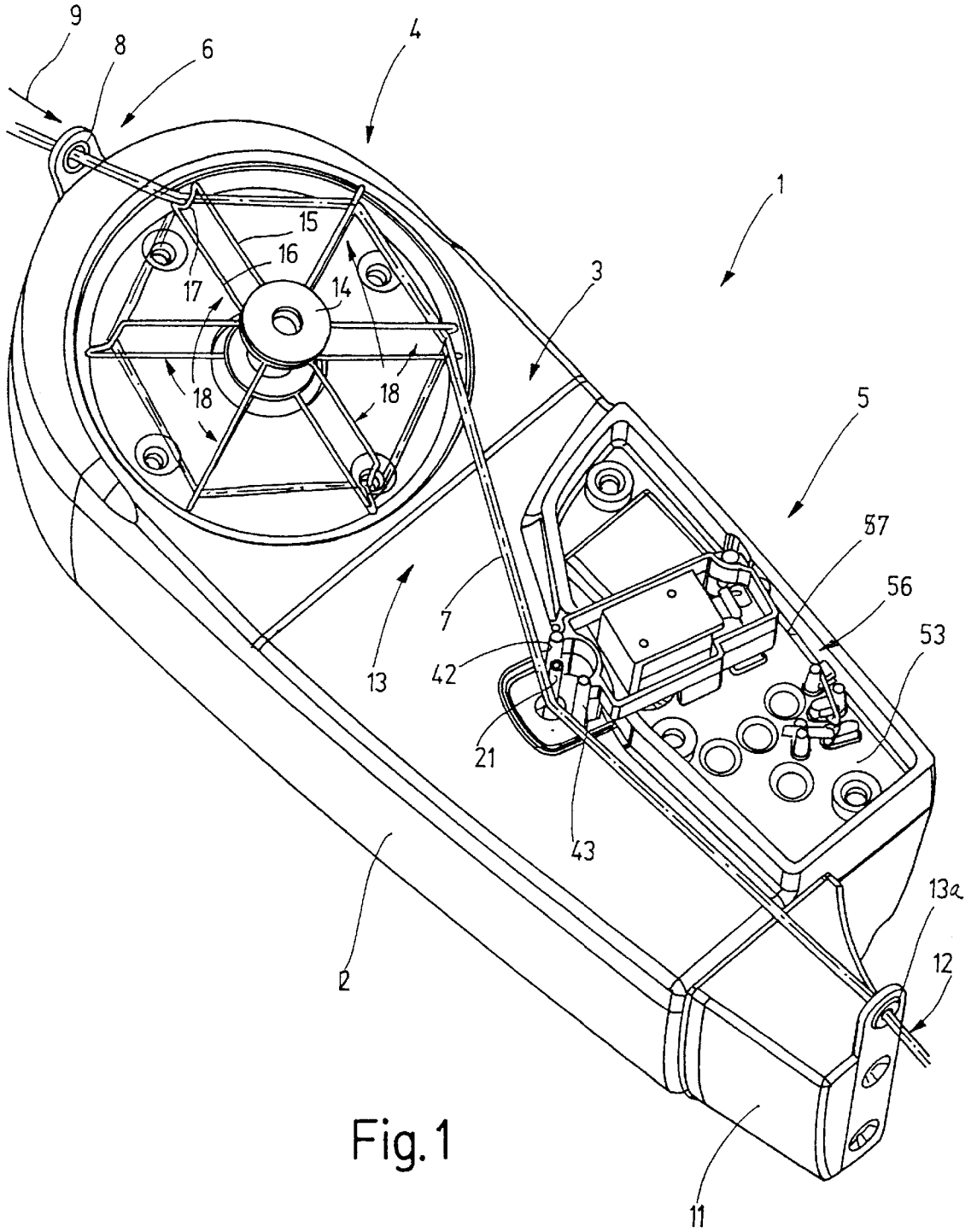
FIG. 1 shows a yarn feeder with a yarn tension sensor with the sensor cover removed, in a complete perspective view.

In FIG. 1, a yarn feeder 1 is shown whose housing 2 has a substantially flat front side 3. A yarn feed wheel 4 and a yarn tension sensor 5 are disposed on it. The housing 2 of the yarn feeder, which is provided with means not further shown for fastening to a knitting machine, in particular a flatbed knitting machine, has next to the yarn feed wheel 4 an eyelet 6 for guiding a yarn 7, which is represented by merely a portion. The eyelet 6 is provided with a ceramic insert 8 and is disposed upstream of the yarn feed wheel 4, with respect to the yarn travel direction represented by an arrow 9. On the opposite end of the housing 2, a further eyelet 12 with a ceramic insert 13*a* is disposed following a signal light 11.

In the yarn travel path 13 defined between the eyelets 6 and 12, the yarn feed wheel 4 serves to feed and supply yarn 7 as needed, and the yarn tension sensor 5 serves to monitor the yarn tension. A regulating device disposed in the housing 2 correspondingly controls a motor that serves drive the yarn feed wheel 4 on the basis of a signal furnished by the yarn tension sensor.

The yarn feed wheel is preferably embodied with six or more vanes and has a plurality of spokes 15, 16, extending radially away from a hub 14, which are each joined together on the ends by a strut 17. One pair of spokes and one strut 17 each define one vane 18. The vanes 18 are disposed at equal angular intervals. The yarn feed wheel 4 therefore defines a polygonal outer circumference, on which the yarn 7 rests in the form of a regular hexagon.

Figure 2:
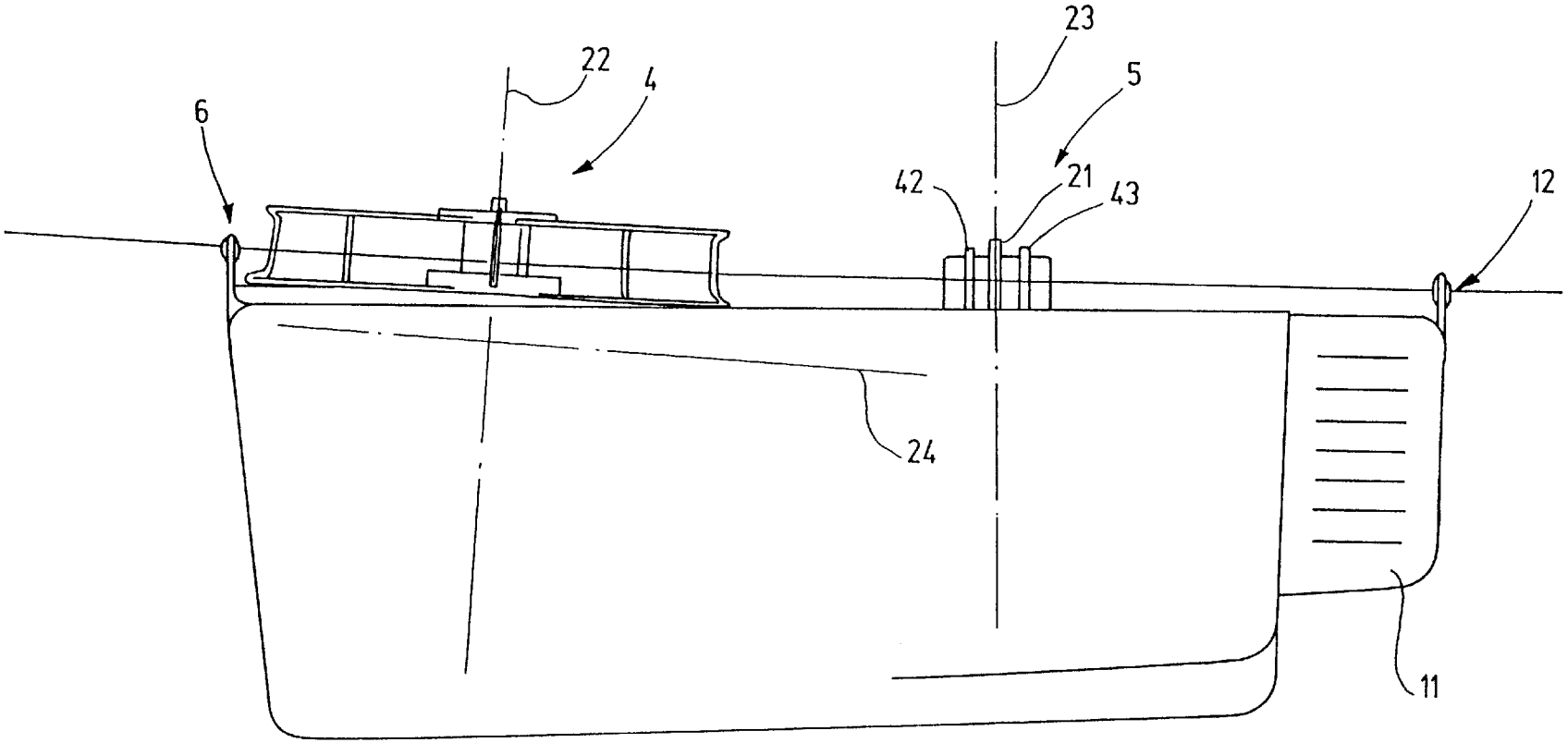
FIG. 2 shows the yarn feeder of FIG. 1 in a schematic side view.

The yarn feed wheel 4 is followed by the yarn tension sensor 5, which has a peg 21 acting as a yarn feeler element. The peg extends crosswise to the yarn 7, which runs in an obtuse angle over the outer circumferential surface of the cylindrical peg 21. As FIG. 2 shows, the yarn feed wheel 4 is rotatable about a pivot axis 22, which is not parallel to a longitudinal axis 23 defined by the peg 21. Advantageous conditions for the yarn on leaving the yarn feed wheel 4 are achieved by means of the oblique position of the yarn feed wheel 4 relative to the peg 21 and thus the yarn 7. The yarn is paid out at a larger angle. This brings about an exact release of the yarn from the yarn feed wheel or other windings taken up by the yarn feed wheel. To the extent that the yarn payout conditions are independent of the orientation of the peg 21, the yarn 7 leads away at an acute angle to an imaginary plane 24 (FIG. 2) for which the pivot axis 22 defines the normal direction. This is achieved by suitable positioning of the eyelet 12.

Figure 3:
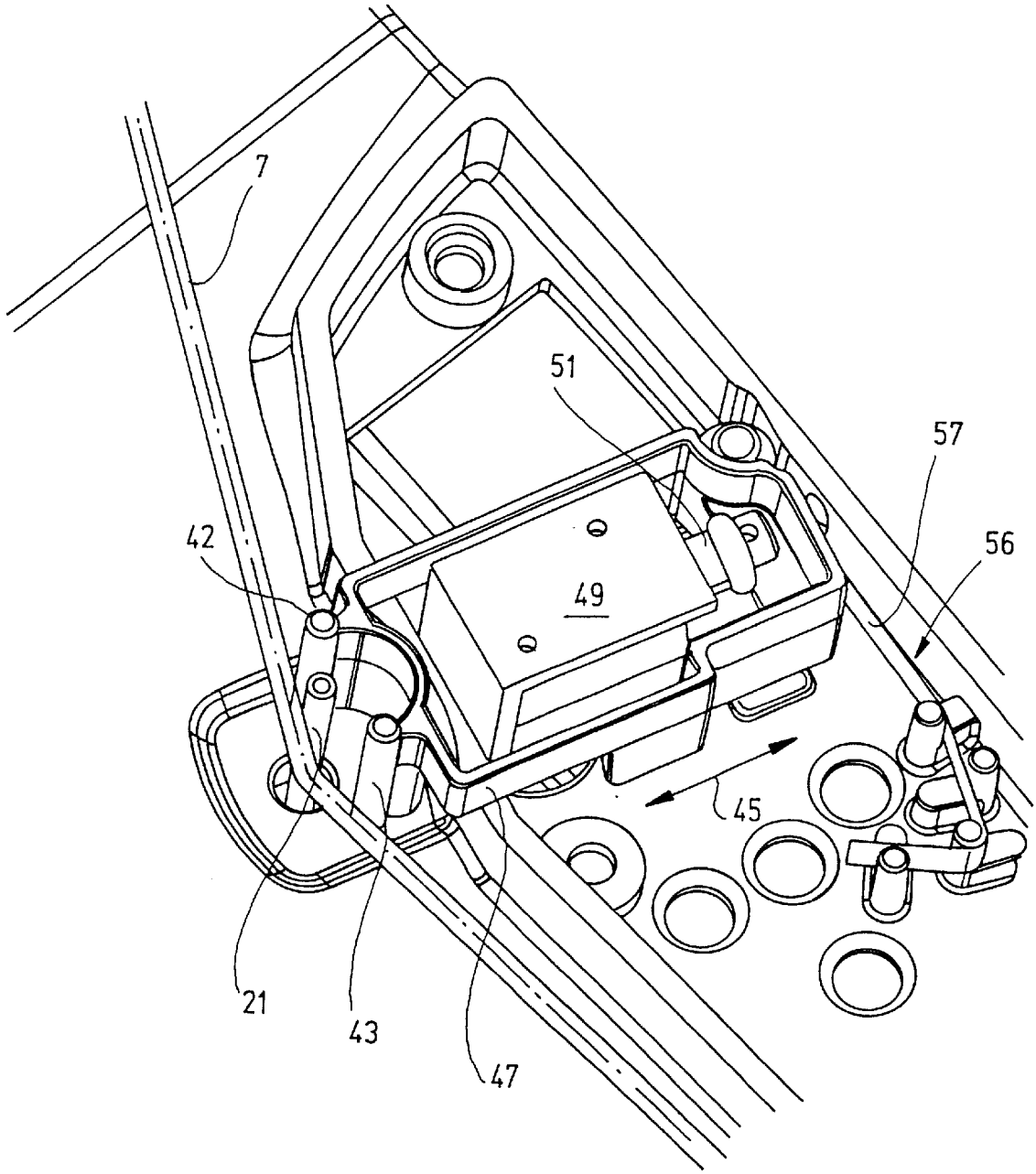
FIG. 3 shows the yarn tension sensor of the yarn feeder of FIGS. 1 and 2 in a simplified perspective view and on a different scale.
Figure 4:
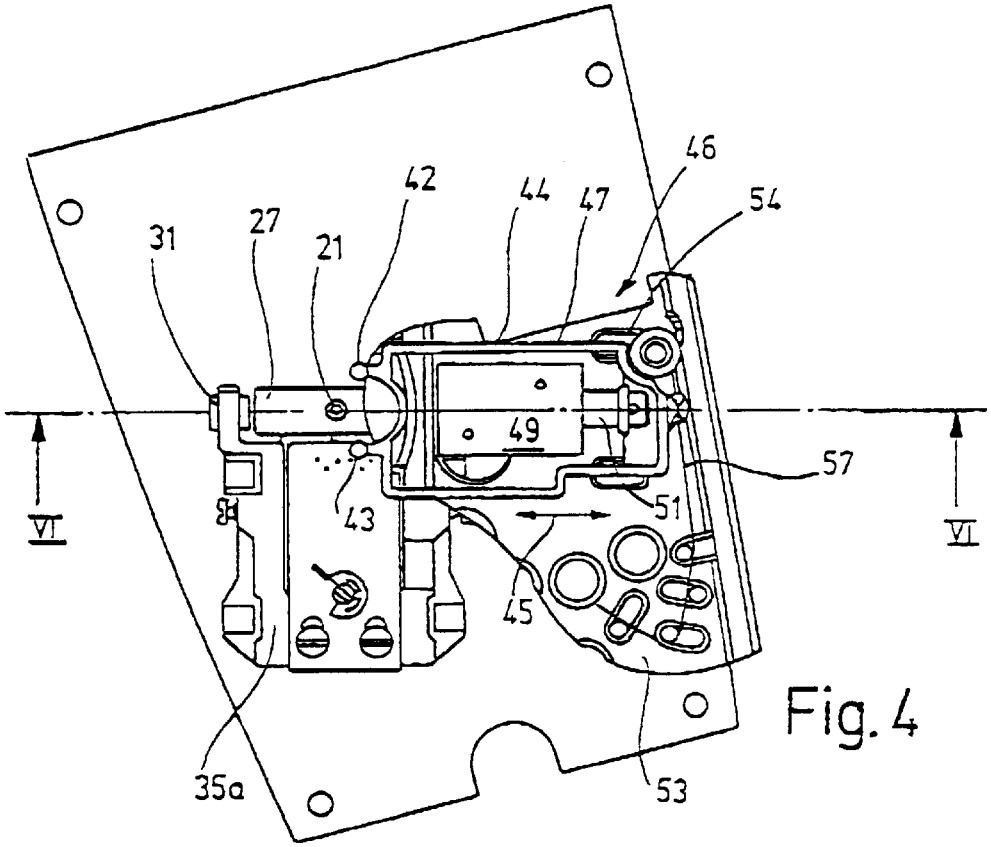
FIG. 4 shows the yarn tension sensor of FIG. 3 in a plan view.
Figure 5:
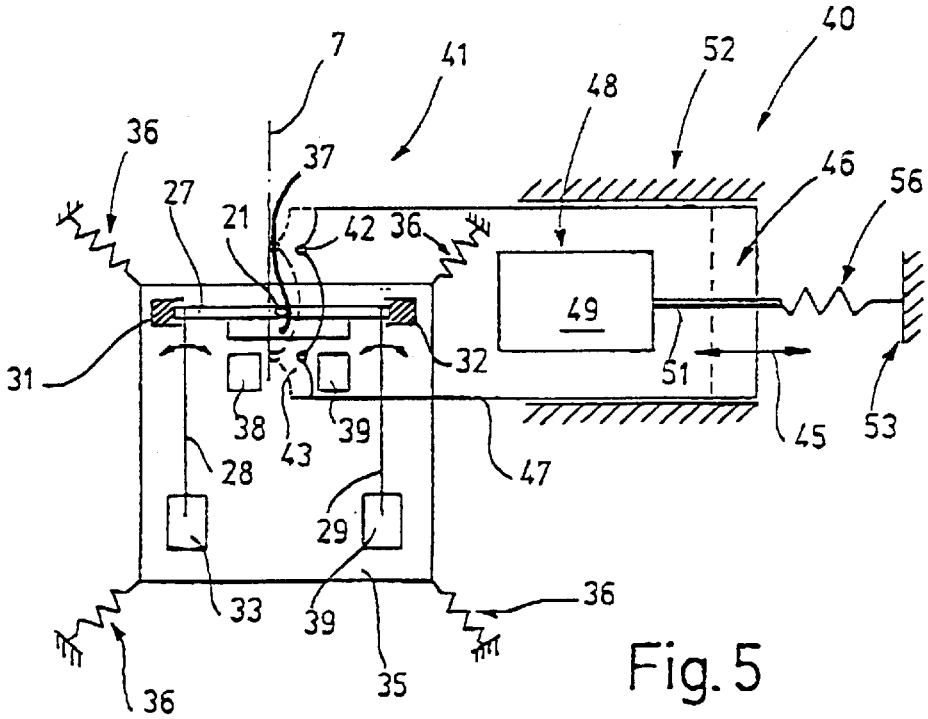
FIG. 5 shows the yarn tension sensor of FIG. 4 in a schematic basic illustration intended to explain its functional principle.
Figure 6:
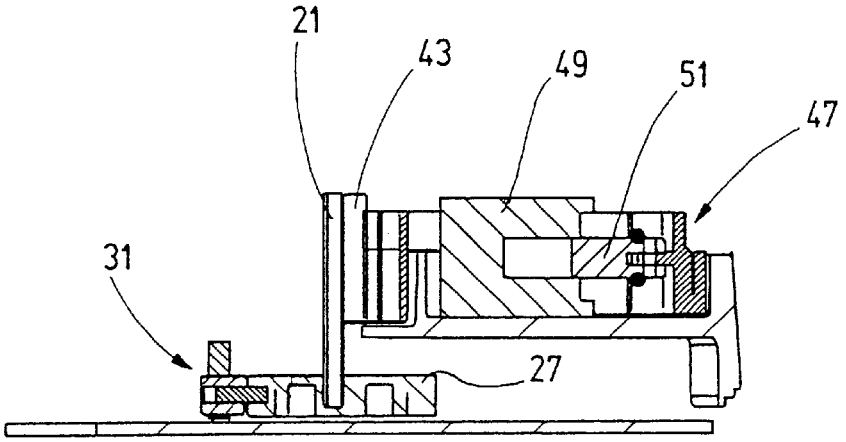
FIG. 6 shows the yarn tension sensor of FIG. 4 in a section taken along the line VI—VI.

The yarn tension sensor 5 can be understood particularly from FIGS. 3–5. The peg 21 is supported on its end on a carrier 27 of low mass, which is held, movable substantially in the longitudinal direction, by two leaf springs 28, 29 disposed in the manner of a spring parallelogram. On the end, the carrier 27 protrudes with cylindrical portions into damper pots or tubules 31, 32, which contain a more or less viscous fluid. By this means, a suppression of high-frequency signal components, in particular, is attained, components that can for instance occur because of the polygonal outline of the yarn feed wheel 4.

Figure 7:
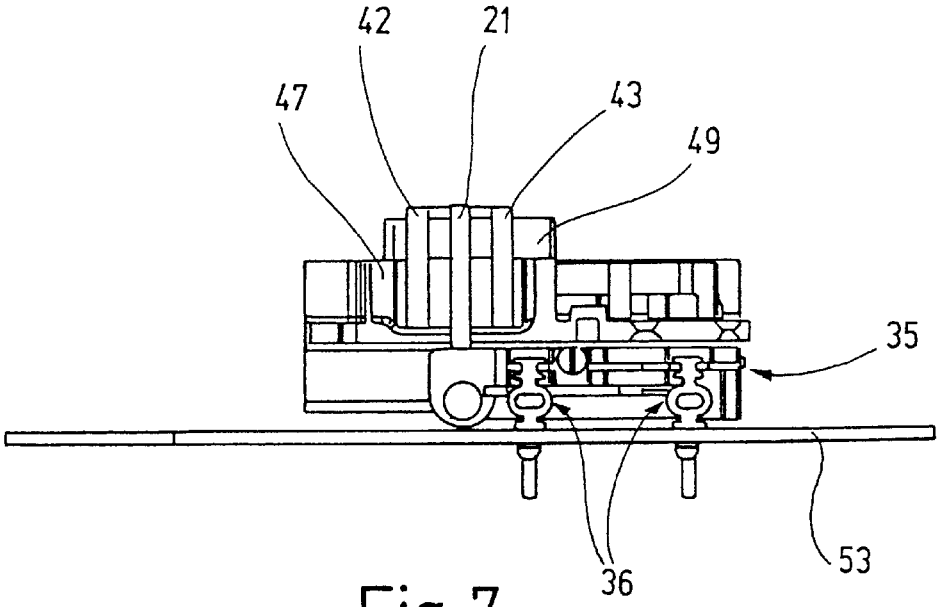
FIG. 7 shows the yarn tension sensor of FIG. 4 in a schematic front elevation.
Figure 8:
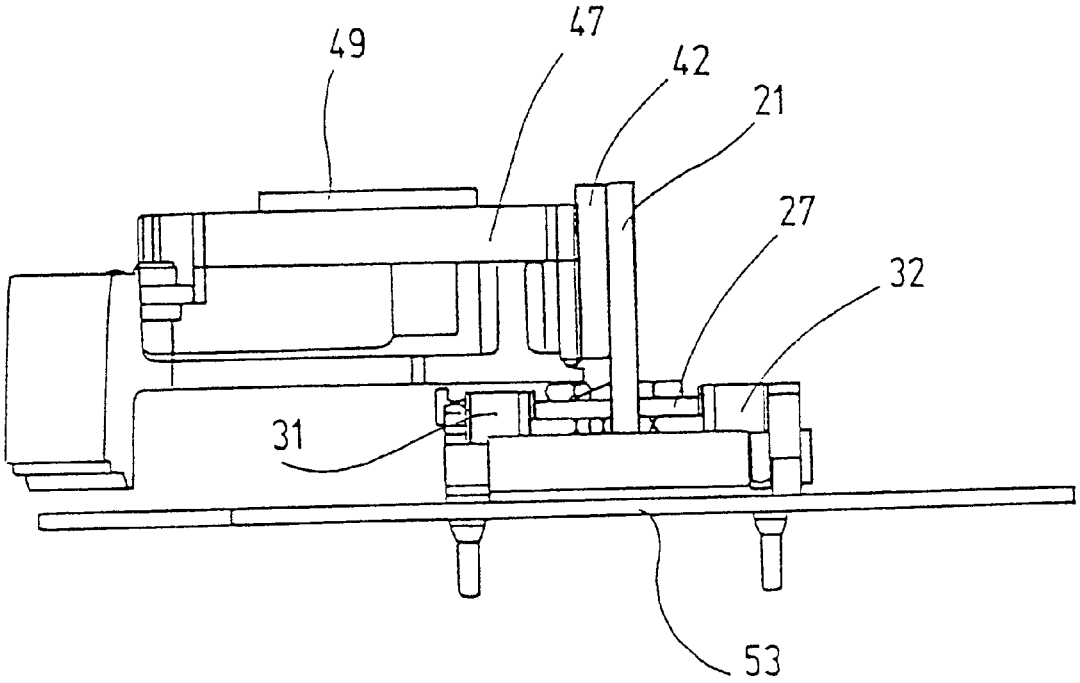
FIG. 8 shows the yarn tension sensor of FIG. 4 in a side view.

The leaf springs 28, 29 are retained on their ends on suitable receptacles 33, 34 which are secured to a base 35. As can be seen from FIG. 7, the base is disposed in stationary fashion with a total of four damper elements 36, which are preferably of rubber. The base 35, as seen from FIG. 4, is formed for instance by a U-shaped yoke 35*a*. A permanent magnet 37 is disposed on the carrier 27, and its magnetic field reaches and influences two Hall sensors 38, 39 disposed in the immediate vicinity. Even a slight shift in the location of the carrier 27 relative to the base 35 is detected by the Hall sensors 38, 39.

The yarn tension sensor 5 includes a calibration device with two pegs 42, 43, acting as yarn takeup systems 41, which are disposed substantially parallel to the peg 21. The pegs 42, 43 are retained on a carrier frame 44, which is movable with the pegs 42, 43 crosswise to the peg 21 in the direction of the arrow 45 (FIGS. 3, 4 and 5). The yarn takeup system 41 can thereby be moved to at least two different positions. In a first position, shown in dashed lines in FIG. 5, the pegs 42, 43 are in a location in which they lift the yarn 7 from the peg 21. In this position, no forces originating in the yarn 7 act on the peg 21.

In a second position of the yarn takeup system 41, which is shown in heavy lines in FIG. 5, the yarn 7 rests only on the peg 21, but not on the pegs 42, 43 of the yarn takeup system 41. The yarn tension now causes a corresponding deflection of the peg 21 and thus results in a sensor output signal.

The yarn takeup system 41 is connected to a drive mechanism 46. To that end, the pegs 42, 43 are held by a frame 47 that surrounds a magnet coil drive 48. Its magnet coil 49 has an armature 51 connected to the frame 47. The frame 47 is supported displaceably in the adjustment direction (arrow 45) by suitable guide means 52, such as oblong slots 54 provided in a base plate 53, or the armature 51.

To prestress the yarn takeup system 41 toward its second, inactive position, the frame is connected to the base plate 53 via a spring means 56. The spring means 56 is preferably a leaf spring 57, which is retained on one end on the base plate 53 and with its opposite end is joined to the frame 47.

Figure 9:
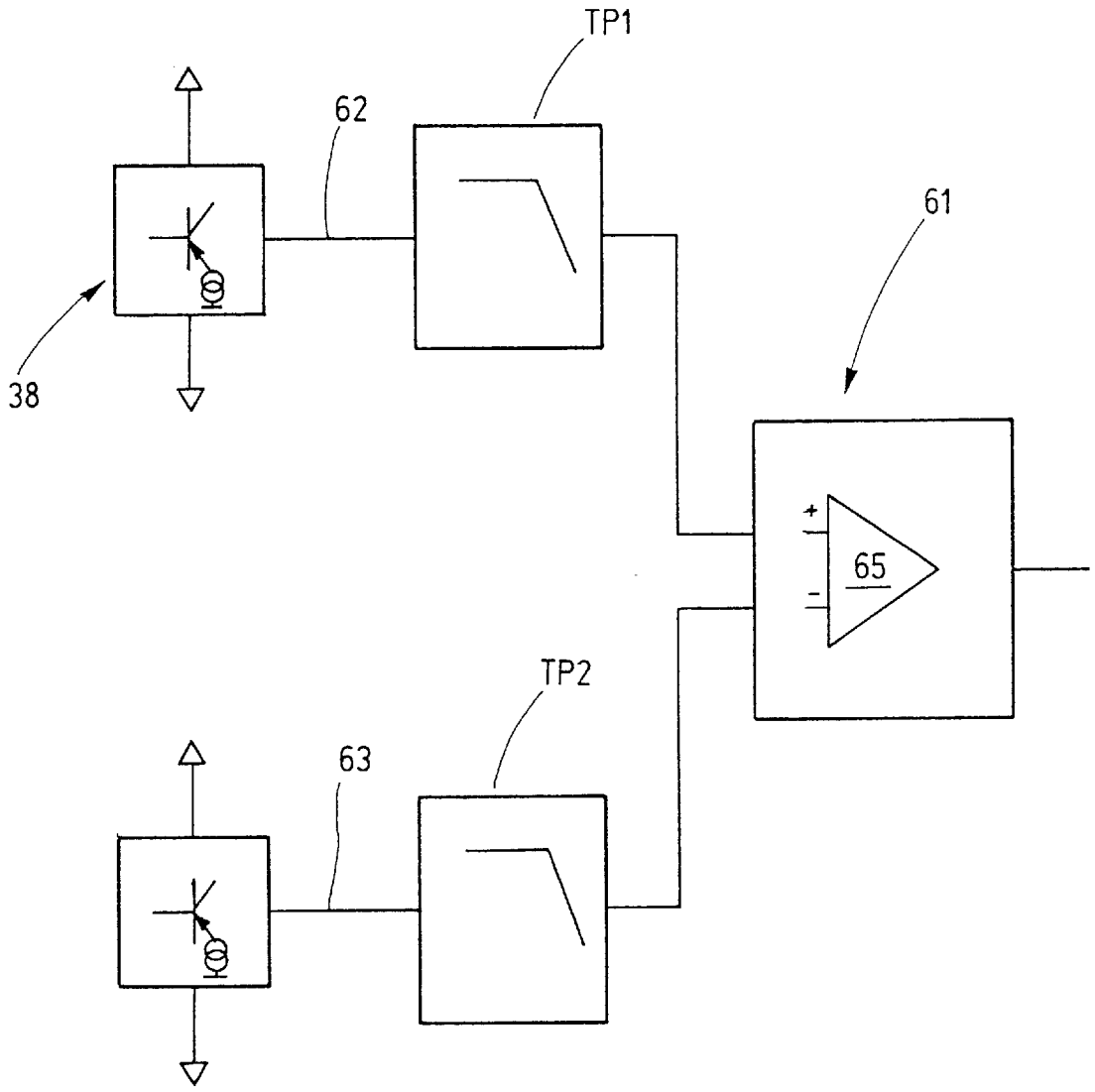
FIG. 9 shows an electrical circuit for signal processing of the output signals of two Hall sensors acting as travel pickups.

The Hall sensors 38, 39, shown only schematically in FIG. 5, are connected as shown in FIG. 9 to a measurement circuit 61, which processes output signals present at outputs 62, 63 of the Hall sensors 38, 39. The Hall sensors 38, 39 are disposed such that they output contrary signals. If the carrier 27 is deflected in one direction, the signal of the Hall sensor 38 increases, for instance, while that of the Hall sensor 39 decreases. For evaluating these signals, the measurement circuit 61 is embodied as a subtractor circuit and to that end includes an operational amplifier 65. This element acts as a differential amplifier. The voltage gains at the noninverting and inverting inputs are identical in amount to one another but differ in their sign. This is assured by suitable wiring.

In addition, the amplifier is preceded by low-pass filters TP1 and TP2, for suppressing higher-frequency components of the sensor signals. At the output, a value for the difference of the output signals of the Hall sensors 38, 39 is thus present that is averaged over time and amplified.

Because of the polygonal outline of the yarn feed wheel 4 and the direct guidance of the yarn to the peg 21 without an intervening bearing surface, the yarn 7 periodically changes its angle to the peg 21. Fluctuations in the sensor signal caused thereby are filtered out by the low-pass characteristic of the measurement circuit 61.

A change in the installed position of the yarn feeder 1, or deposits on the peg 21 and on the mounts of the magnet 37, or changes in the temperature or drift phenomena in the Hall sensors 38, 39 and temperature drift or aging of the measurement circuit 61 can gradually lead to a change in the output signal at the output of the measurement circuit 61. To detect a zero point shift of this kind, the yarn feeder 1 is provided with an automatic calibration or zero point calibration circuit. This circuit is connected to the magnet coil 49.

The yarn feeder 1 carries out its calibration as follows:

First, it is assumed that a knitting machine provided with the yarn feeder 1 and not otherwise shown is not in operation. The yarn feeder 1 is turned off, but its electronic circuit is active. It is in a waiting state. To put the knitting machine into operation, among other steps, the yarn feeder 1 is also activated. The calibration circuit to that end briefly triggers the magnet coil 49, which attracts the armature 51. This pushes the frame 47 so far toward the peg 21 that the pegs 42, 43 bypass the peg 21 and lift the yarn 7 away from the peg 21. The peg 21 is now free of yarn forces, and the signal output by the measurement circuit 61 in this state marks the zero point, or in other words the yarn tension of zero.

As soon as this value is detected and recorded, the excitation of the magnet coil 49 is turned off, so that the armature 51 drops, and the frame 47 is returned by the spring means 56 to its retracted position. The yarn 7 is placed on the peg 21 in the process, and the pegs 42, 43 release the yarn 7. The force now exerted by the yarn 7 on the peg 21 causes a shift in the carrier 27, which is detected by the Hall sensors 38, 39 and indicated as an output signal by the measurement circuit 61. This signal serves as an actual value signal for a closed control loop that controls the motor of the yarn feed wheel 4.

If yarn consumption then occurs, the closed control loop triggers the motor in each case in such a way that the yarn feed wheel 4 furnishes the required quantity of yarn to keep the yarn tension constant.

The prevention of errors from zero point drifting that occurs after the yarn feeder is put into operation can be accomplished by repeating the described calibration operation often. This is possible in particular in time slots in which, during the operation of the yarn feeder 1, the yarn feed wheel 4 and thus the yarn 7 come to a stop. This state is characterized for instance by a corresponding controller output signal (motor trigger voltage equal to zero). To detect such time slots, the calibration circuit monitors the controller output signal. If such a time slot is occurring, then the calibration operation, which takes only a few milliseconds or a few tens of milliseconds, is tripped; that is, the magnet coil 49 is briefly excited, and the zero calibration of the measurement circuit 61 is formed taking the resultant output signal as the zero value.

Figure 10:
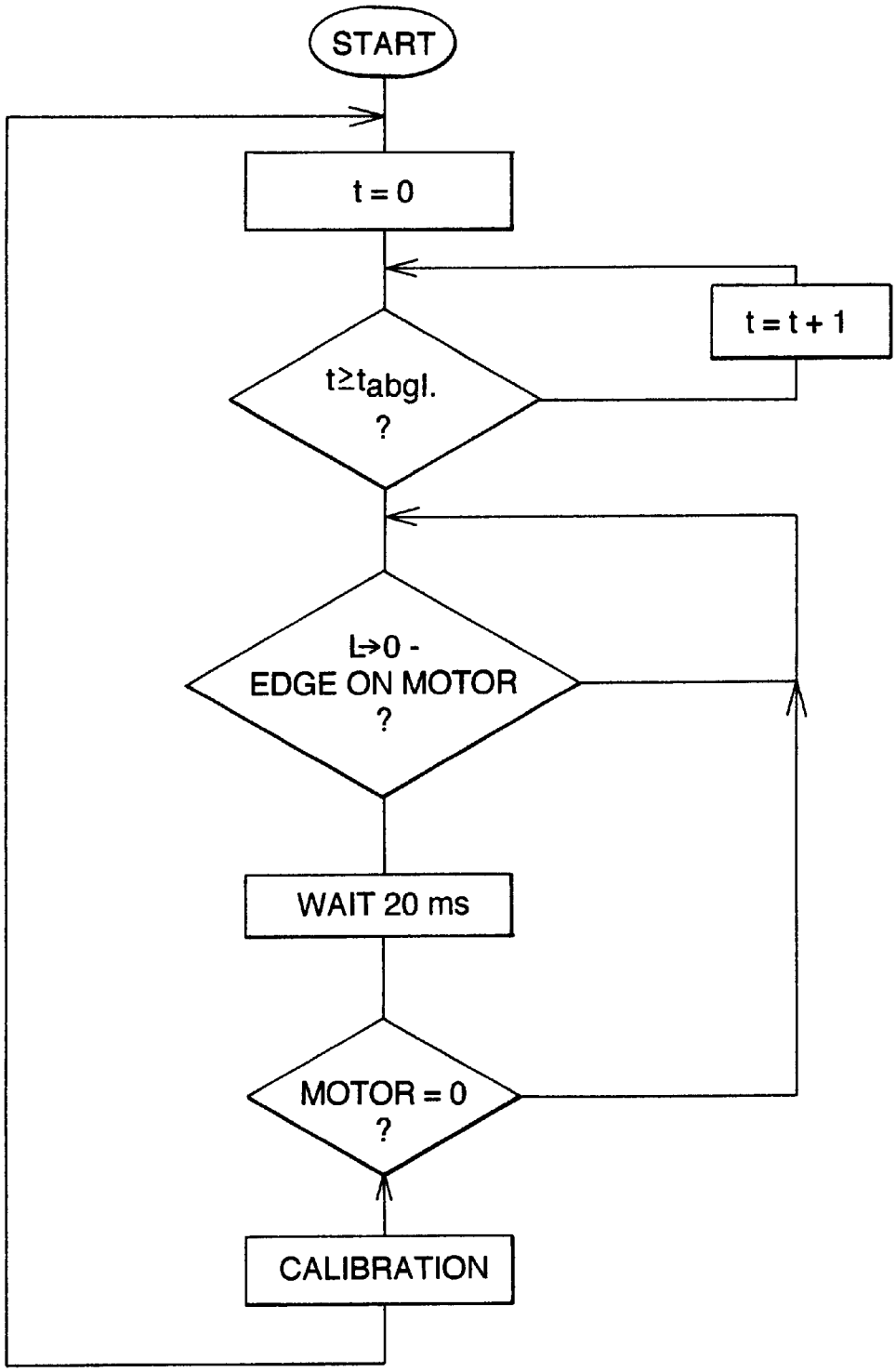
FIG. 10 shows a flowchart to illustrate the method in the zero calibration of the yarn tension sensor.

To detect possible time slots, there is first a wait time period, as shown in the flowchart of FIG. 10, until an internal time $t_{abgl.}$, which can be preset, has elapsed. The time $t_{abgl.}$ is the time interval within which a zero calibration should be performed. It ranges between a few minutes and one hour. Once the interval time has elapsed, the controller output signal is first examined for whether it is tending toward zero. After that, a check is made as to whether it remains at zero for a given length of time, such as 20 ms. If so, then a time slot is occurring, and a wait ensues until the motor of the yarn feeder mechanism has been intentionally stopped and remains stopped for a relatively long time (500 ms). During such a time slot, the calibration can be performed. The detection of the time slots is preferably done in an edge-triggered way.

In a machine where the yarn consumption intermittently stops, an automatic calibration can be done at the carriage or yarn guide reversal, which occurs when the motor of the yarn feed wheel 4 stops. Once such a motor stop is detected, then after a predetermined variable length of time an automatic calibration can be performed. In this way, it is possible for even brief and relatively rapidly ensuing drifting within the entire system to be detected and rendered harmless.

A yarn feeder 1 intended in particular for machines in which yarn consumption is intermittently absent and with elastic yarns has a yarn tension sensor 5 which is provided with a calibration device 40. The calibration device lifts the yarn 7 from a peg 21, belonging to the yarn tension sensor 5, at times when this can be done without impairing the operation of the yarn feeder 1. Such times are preferably time slots when no yarn feeding is necessary. Once the yarn 7 is lifted from the peg 21, a zero point calibration is performed, so that zero point drifting in the entire sensor system, including its measurement circuit 61, is detected and can be compensated for.

What is claimed is:

1. A yarn tension sensor (1) for detecting the tension of a moving yarn (7), comprising:

a yarn feeler element (21), which is disposed in a yarn travel path and has a bearing face for the yarn (7), a measuring device (5), connected to the yarn feeler element (21), for detecting the force exerted by the yarn (7) on the yarn feeler element (21), and an actuator device (48), by means of which the yarn feeler element (21) and the yarn (41) are movable relative to one another between a calibration position and a measurement position in such a way that in the calibration position, the yarn does not rest on the yarn feeler element (21), and in the measurement position, the yarn does rest on the yarn feeler element (21).

2. The yarn tension sensor of claim 1, characterized in that the direction of motion defined by the actuator device (48) is defined crosswise to the yarn.

3. The yarn tension sensor of claim 1, further comprising a yarn takeup system (41), and characterized in that the yarn takeup system (41) and the yarn feeler element (21) are disposed on the same, defined side of the yarn, and that the yarn takeup system (41) in the calibration position lifts the yarn from the yarn feeler element (21) and in the measurement position does not rest on the yarn, but the yarn rests on the yarn feeler element (21).

4. The yarn tension sensor of claim 1, further comprising a yarn takeup system (41), and characterized in that the yarn takeup system (41) and a slit (21), in which the yarn feeler is disposed, are disposed on defined, opposed sides of the yarn, and that in the calibration position, the yarn takeup system (41) causes the yarn to be lifted from the yarn feeler element (21) and, in the measurement position, it keeps the yarn in contact with the yarn feeler element (21).

5. The yarn tension sensor of claim 1, further comprising a yarn takeup system (41), and characterized in that the actuator device (48) is connected to the yarn takeup system (41) in order to move the yarn takeup system out of the calibration position into the measurement position and back, and that the yarn feeler element (21) is disposed substantially, that is, except for its measurement travel, in stationary fashion.

6. The yarn tension sensor of claim 5, characterized in that the actuator device (48) is an electric linear drive mechanism (49, 51, 56).

7. The yarn tension sensor of claim 1, characterized in that the actuator device (48) is an electric linear drive mechanism (49, 51, 56).

8. The yarn tension sensor of claim 1, further comprising a yarn takeup system (41), and characterized in that the yarn takeup system (41) is formed by at least one yarn receiver (42, 43), which is disposed adjacent to the yarn feeler element (21).

9. The yarn tension sensor of claim 1, characterized in that the yarn feeler element (21) is supported movably and substantially crosswise to the yarn travel path, and the measuring device (5) includes a travel pickup system (38, 39).

10. The yarn tension sensor of claim 9, characterized in that the travel pickup system (38, 39) has two travel pickups, which are connected to a measurement circuit (61), which includes a subtractor (65) to whose inputs (+, −) the travel pickups of the measuring device (5) are connected.

11. The yarn tension sensor of claim 1, characterized in that the yarn feeler element (21) is supported by means of a spring parallelogram (28, 29) on a base (35) that also supports a travel pickup system (38, 39) and is supported (36) resiliently and/or in damped fashion.

12. The yarn tension sensor of claim 1, characterized in that the yarn feeler element (21) is a peg disposed crosswise to the direction of motion of the yarn (7), and the yarn (7) is unguided with respect to the longitudinal direction of the peg.

13. The yarn tension sensor of claim 1, further comprising a yarn takeup system (41), and characterized in that the yarn takeup system (41) is part of a calibration device (40), which is intended for setting a reference value for the measuring device (5).

14. The yarn tension sensor of claim 13, characterized in that the calibration device (40) is activatable by a signal, output by the machine, that defines a state in which the yarn (7) has a speed which is less than a predetermined limit value.

15. The yarn tension sensor of claim 14, characterized in that the limit value of the yarn speed is zero.

16. The yarn tension sensor of claim 1, characterized in that a regulating device for keeping the yarn tension constant is connected to the measuring circuit (61), and that the regulating device has an inactivation input, and the regulating device does not change its output signal when a corresponding signal has arrived at the inactivation input.

17. A yarn feeder for knitting machines with highly fluctuating yarn consumption, comprising:

a yarn feed wheel (4) driven by an electric motor, a regulating device for triggering the electric motor (4) such that the requisite yarn quantity is supplied and the yarn tension is kept within predeterminable limits, the yarn tension sensor (5) of claim 1, and a calibration device (40) for the yarn tension sensor (5) which is activated by a calibration pulse and by which the yarn takeup system (21) and the yarn tension sensor can be moved to the calibration position with respect to one another for calibration of the yarn tension sensor (5).

18. The yarn feeder of claim 17, characterized in that the yarn feed wheel (4) has a pivot axis (22), which is disposed in the direction that is normal to a plane (24) with which the outgoing yarn (7) forms an acute angle.

19. The yarn feeder of claim 18, characterized in that the calibration device (40) is activatable upon a change of direction of the yarn guide of a flatbed knitting machine or in a change of yarn in stocking and sock knitting machines, or in other pauses in yarn consumption by machines.

20. The yarn feeder of claim 18, characterized in that the calibration device (40) is controlled by the yarn speed.

21. The yarn feeder of claim 20, characterized in that the calibration device (40) is inactive at least whenever the yarn speed exceeds a limit value.

22. A method for calibrating a yarn tension sensor comprising the steps of:

detecting a signal that defines a state in which the yarn tension is allowed to deviate briefly from its set-point value, separating a yarn from the yarn tension sensor, detecting the signal output by the yarn tension sensor once the yarn has lifted, and placing the yarn on the yarn tension sensor again.

23. The method of claim 22, characterized in that the signal defines a yarn speed that is less than a predetermined limit value.

24. The method of claim 22, characterized in that the measured value detected with the yarn lifted is taken as the zero value.

25. The method of claim 22, characterized in that the calibration operation in a flatbed knitting machine is performed at the reversal of direction and/or upon starting.

26. The method of claim 22, characterized in that the calibration operation is performed with the yarn in motion within a time slot in which the yarn speed is constant.

* * * * *